United States Patent [19]

Warren

[11] 4,080,277

[45] Mar. 21, 1978

[54] SHORT CIRCUIT PROTECTION FOR HORIZONTAL MERCURY ELECTROLYTIC CELLS

[75] Inventor: Jack Warren, Stamford, Conn.

[73] Assignee: Olin Corporation, New Haven, Conn.

[21] Appl. No.: 688,650

[22] Filed: May 21, 1976

[51] Int. Cl.[2] ..... C25B 15/04; C25B 15/06; C25B 1/40

[52] U.S. Cl. ..... 204/225; 204/219; 204/250

[58] Field of Search ..... 204/219–220, 204/250, 225, 99

[56] References Cited

U.S. PATENT DOCUMENTS

| | | | |
|---|---|---|---|
| 3,531,392 | 9/1970 | Schmeiser | 204/225 |
| 3,594,300 | 7/1971 | Schafer | 204/225 |
| 3,654,118 | 4/1972 | Selwa | 204/225 |
| 3,689,398 | 9/1972 | Caleffi | 204/225 X |
| 3,734,848 | 5/1973 | Bertoni et al. | 204/220 |
| 3,763,024 | 10/1973 | Engelmann et al. | 204/225 X |
| 3,844,913 | 10/1974 | Warren | 204/99 |
| 3,853,723 | 12/1974 | Mack | 204/99 |
| 3,902,983 | 9/1975 | Warren | 204/225 |
| 3,944,995 | 3/1976 | Kobayashi et al. | 204/225 |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

An improvement for use in conjunction with the preventing of short circuits in one of a plurality of electrolytic cells and one of a plurality of horizontal mercury cells electrically connected in series with each cell having means for raising a plurality of anodes relative to the cathode and a plurality of anode buses. Switch means are associated with at least two of each plurality of anode buses for closing an electric circuit upon sensing a short circuit condition. The closing of the electric circuit results in the lighting of the lamp indicating which one of the plurality of anode buses the switch that has closed is associated with, a lamp for indicating which one of the plurality of cells the switch that has closed is associated with, and causes the raising of the plurality of anodes with which the switch that has closed is associated.

10 Claims, 3 Drawing Figures

SHORT CIRCUIT PROTECTION FOR HORIZONTAL MERCURY ELECTROLYTIC CELLS

This invention relates to an improvement in short circuit protection for electrolytic cells. More particularly, this invention relates to an improvement in short circuit protection for horizontal mercury electrolytic cells wherein anodes are raised to prevent a short circuit.

Horizontal mercury cells usually comprise a covered elongated trough sloping slightly toward one end. The cathode is a flowing layer of mercury which is introduced at the higher end of the cell and flows along the bottom of the trough toward the lower end. The anodes are spaced a short distance above the flowing mercury cathode.

The anodes may comprise rectangular blocks of graphite having conductive lead-ins such as graphite or copper tubes or rods. Anodes of other materials are also suitable in mercury cathode cells, particularly titanium anodes having a thin coating of platinum metal or oxide over at least part of their surfaces. By the term "platinum metal" for the purpose of this specification is meant an element of the group consisting of ruthenium, rhodium, palladium, osmium, iridium, and platinum, or alloys of two or more of these metals. The term titanium is meant to include alloys consisting essentially of titanium.

In a horizontal mercury cell, whether the anode is graphite or metal, the distance between the anode and the cathode is very important. The inter-electrode distance should be as small as possible to reduce the wasteful consumption of energy. However, if the distance is too small, secondary reactions may take place, reducing the efficiency of the cell.

Problems arise, however, in the operation of mercury cells when short circuits occur. Such short circuits may be caused by breakage of a graphite anode, by loosening of anode support posts, by changes in thickness of the mercury due to faulty flow control, or other causes which allow the anode to contact the flowing mercury cathode. The resulting short circuit causes an excessive flow of current in the anode and in the anode bus serving that anode, along with overheating of the anode leads, loss in production of chlorine, excessive hydrogen in the chlorine, and other problems. In addition, with a metallic anode of the type described above, a short circuit rapidly removes the coating, and the loss of a platinum metal or oxide coating cannot be economically tolerated.

A plurality of electrolytic cells are normally electrically connected together in an electrical series circuit. Each cell may have a plurality of anode buses which are electrically connected to the cathode side of an adjacent cell. The anodes of each cell may be divided into sets with each set of anodes being separately adjustable to raise and lower the anodes of a given set simultaneously with respect to the mercury cathode. Each set of anodes may be provided with one or a plurality of anode buses.

It is known today to provide automatic adjustment of anodes wherein a set of anodes of a given cell is raised with respect to the mercury cathode in response to the sensing of an appropriate condition signalling a short circuit. U.S. Pat. No. 3,574,073 discloses a protective circuit wherein a reed switch is provided on each anode bus. The reed switch is responsive to changes in the flux of the magnetic field generated by current flow in the bus serving the anodes. The reed switch controls the opening and closing of an electrical circuit which activates a motor effective to raise the anodes a predetermined amount as a rise in current in the bus is sensed. As will be noted in the above-mentioned patent, the cell disclosed has two buses serving a set of five anodes. Each set of five anodes is provided with a motor which when activated can raise or lower that set of anodes separately from the remainder of the anodes in the cell. The electrical circuit shown in the patent in connection with the switch employs an indicating light for each of the anode sets to indicate when one of the reed switches associated with that set has been activated.

Although the above-described arrangement is generally satisfactory in the case where a cell is provided with a plurality of anode sets with a relatively few, such as two, anode buses associated with each set, some problems are encountered in the case where the activation of any one of a relatively large number of reed switches serves to raise all, or a large group, of anodes in the cell. For example, there are some cells in existence wherein the anodes are directly supported by the cell cover, and the cover is moved in a vertical direction to adjust the anode-cathode spacing. A plurality of anode buses are associated with cells of this type.

In the case where a set of a few anodes is raised and lowered individually with a relative few, such as two, anode buses serving a given set, an operator, by being provided with an indication that that set had been raised, would known within two which particular reed switch had operated; namely, one of the two on the buses serving that anode set.

On the other hand, in the case where the anodes are not grouped in sets in the cell for the purpose of being able to be raised as a set, any one of a large number of reed switches can cause the cell cover and, hence, the anodes to be raised. Thus, any one of the plurality of reed switches can be indicating an anode short or a railed reed switch without the operator knowing which one.

It is an object of the present invention to provide a method and apparatus for adjusting electrodes wherein an indication is given as to which one of a plurality of reed switches has caused the anodes to be raised with respect to the cathode.

According to the present invention, each anode bus of each cell of the plurality of cells is provided with a switch which will close upon the sensing of a short circuit condition. The switch is electrically connected to an electrical circuit which when closed by the switch will indicate which bus is associated with the switch which has been activated, which will provide an indication of which cell the switch which has been activated is associated with, and which will cause the motor associated with the anodes of the particular cell to be activated to cause the anodes to raise until the switch opens.

The method of the present invention includes sensing a short circuit condition at one of a plurality of anode buses of one of a plurality of electrolytic cells, activating an electrical circuit in response to the sensing of the short circuit, indicating in response to the activation of the electrical circuit which one of a number of anode buses caused the sensing of the short circuit and at which one of a plurality of cells the short was sensed, and raising the anodes automatically in response to the activation of the electrical circuit.

A better understanding of the present invention may be utilized by reference to the following description of a preferred embodiment and to the accompanying drawings, in which.

Figure 1:
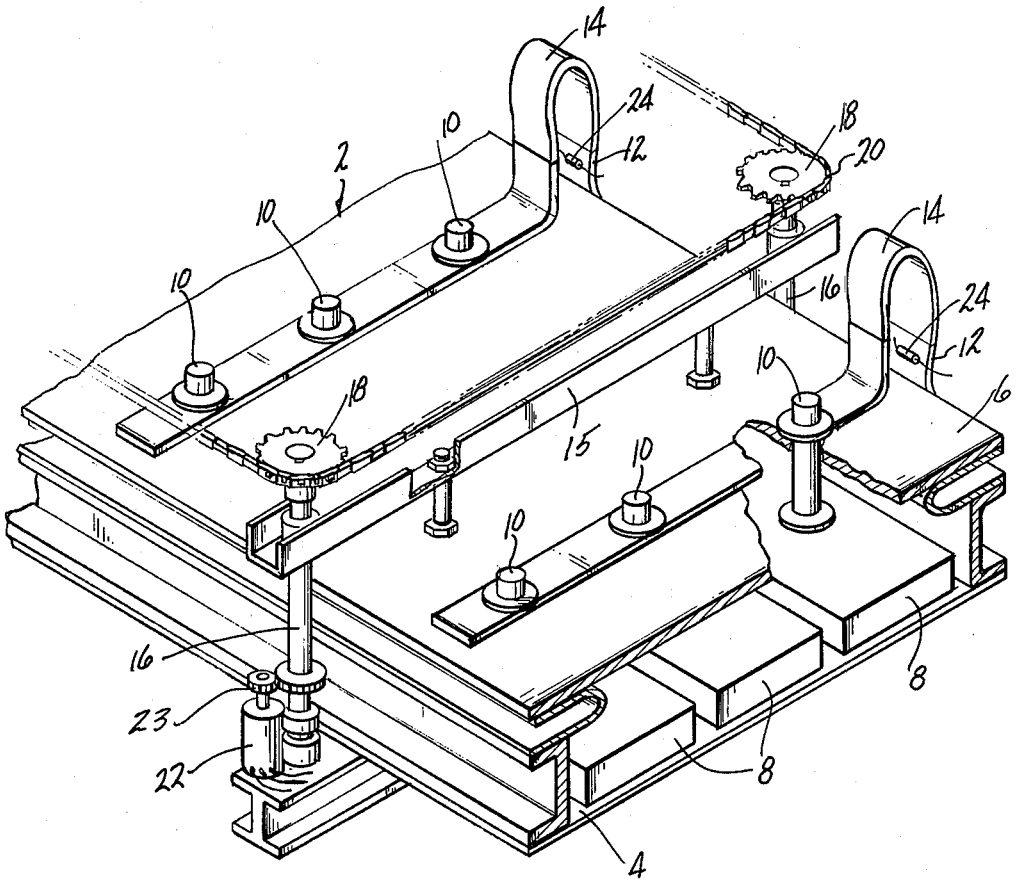
FIG. 1 is a partial sectional view of a mercury cell of the general type to which the present invention may be applied.

Referring to the drawings, and in particular to FIG. 1, there is shown a mercury cathode chlor-alkali electrolytic cell 2 of a type with which the present invention may be used. The cell 2 includes a trough 4 and a movable cover 6. The mercury cathode (not shown) flows along the bottom of the trough 4. A plurality of anodes 8 are attached to the movable cover 2. The anodes 8 may be arranged so that there are three anodes in spaced side-by-side relationship across the cell and 32 anodes in end-to-end relationship lengthwise of the cell for a total of 96 anodes per cell. The cell 2 may be one of a plurality of cells connected in an electrical series circuit.

Each anode 8 may include a plurality of anode lead-in posts 10 in spaced relationship. As shown, there are two lead-in posts 10 associated with each anode 8. An anode bus 12 mounted on the side of the cell is connected to three side-by-side anode lead-ins 10 through a flexible electrically conductive connector 14. With the arrangement shown, if there are 96 anodes as described above, there will be 64 anode buses 12 associated with each cell.

The cell cover 6 may be attached to a crossbar 14 which in turn is mounted on jacking screws 16. The cell 2 may be provided with a plurality of such crossbars 14 to properly support the cell cover 6. Each of the jacking screws 16 may be provided with a sprocket 18 at its upper end which are inter-connected by a chain drive means 20. A suitable electric motor 22 is mounted near the cell 2 and is provided with suitable drive means 23 to drive one of the jacking screws 16 with the chain drive means 20 providing a driving force to the other jacking screws 16. Operation of the motor 22 in one direction causes the jacking screws 16 to revolve about their axis in one direction and raise the cell cover 6 along with the anodes 8 relative to the mercury cathode. Operation of the motor in the other direction causes the cell cover 6 and anodes 8 to lower.

It is to be understood that the above description of a chlor-alkali cell is merely illustrative of the type of cell with which the present invention may be used. The cell may have a greater or lesser number of anodes 6 spaced in various combinations. In addition, a greater or lesser number of anode buses may be utilized as desired. More then one motor may be provided if desired. The present invention also has application in cells of the type wherein the cover is stationary and the anodes are raised relative to the cover. The present invention can also be utilized with cells wherein the anodes of a cell are grouped in sets with the anodes of a given set able to be raised independently of other sets. This is especially true when more than one anode bus 12 is associated with the set of anodes.

According to the present invention, each anode bus 12 of each cell 2 is provided with a switch 24 which is adapted to close upon sensing a short circuit condition. One type of switch suitable for this purpose is a reed switch 24 which is an encapsulated magnetic switch which is actuated by the magnetic field generated by the current flow in the bus.

Figure 2:
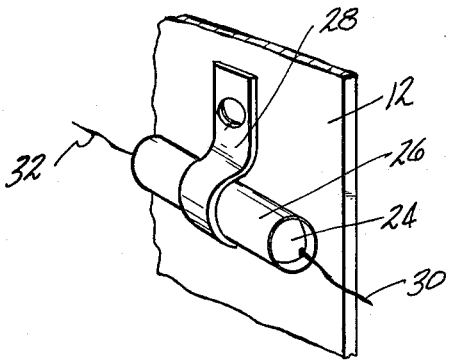
FIG. 2 is a detailed view of the mounting of each reed switch.

FIG. 2 shows the detail of mounting of the reed switch 24. The reed switch 24 is enclosed in a steel pipe 26 and is clamped to the bus 12 by a clamp 28. The steel pipe 26 provides suitable shielding for this service. The reed switch 24 is most sensitive when perpendicular to the length of the bus 12 and will not operate when parallel with the bus 12. The angle of the reed switch 24 to the length of the bus is adjusted to cause the switch to close under the influence of a magnetic field of any desired strength corresponding to any desired flow of current in the bus.

Figure 3:
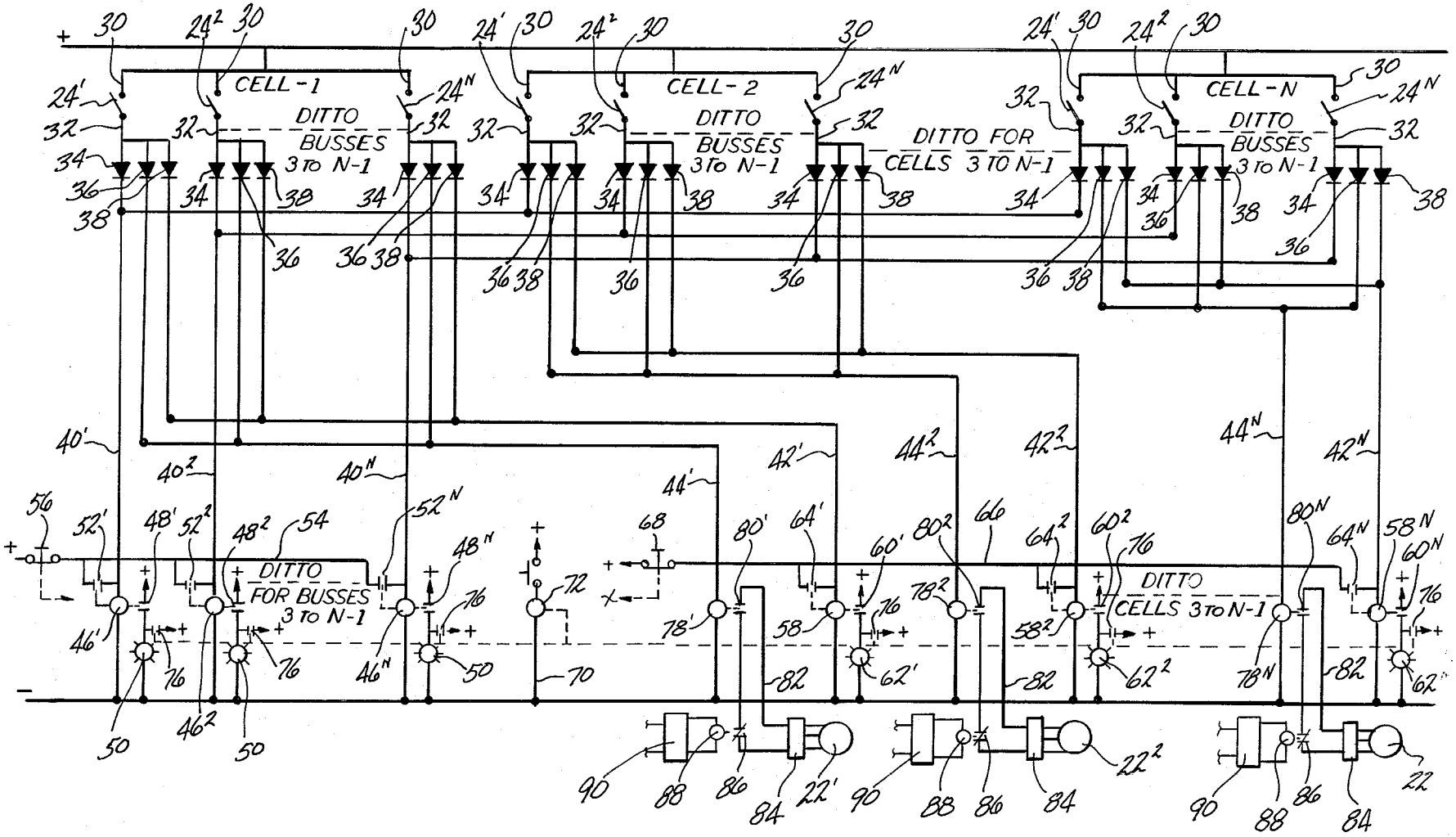
FIG. 3 is a schematic electrical diagram showing the electrical circuit of the present invention.

Referring to FIG. 3, the present invention may be utilized with any number "N" of cells. Each cell has a reed switch 24 associated with each of its anode buses which may also be of any number "N". Cell No. 1 includes a reed switch $24^1$ associated with anode bus No. 1, a reed switch $24^2$ associated with anode bus No. 2, with the last bus No. "N" being provided with a reed switch $24^N$. Cells 2 through N are similarly provided with reed switches $24^1$ through $24^N$ on each of the anode buses.

It is to be noted that in connection with FIG. 3, the superscript used in connection with some of the reference numerals indicates either the bus number or cell number that the given component is associated with.

One lead 30 of each reed switch 24 is connected to the positive side of a suitable power supply (not shown for the sake of clarity). For example, the power supply may be 24 volt direct current which may be converted from a 115 volt AC current. The other lead 32 of each reed switch splits into three separate branch circuits through three diodes 34, 36, and 38. The branch circuits comprise a bus indicating circuit 40, a cell indicating circuit 42, and an anode raise circuit 44.

A bus indicating circuit 40 is provided for each reed switch 24 of a cell, with the reed switch 24 of the same number bus of each cell connected to the same circuit 40. Thus, reed switches $24^1$, associated with the first bus of each cell, are connected to the same bus indicating circuit $40^1$, and likewise for switches $24^2$ through $24^N$.

Each bus indicating circuit 40 includes a bus relay coil 46 which is connected to the reed switch 24 through diode 34 and to the negative side of the power source. Each bus relay coil 46 operates a normally open bus relay contact 48 which is interposed between the positive side of the power source and an indicating lamp 50 of any appropriate type which in turn is connected to the negative side of the power source.

The lamps 50 may be mounted in a panel which may include some type of legend to provide the operator with the assigned number of the bus with which the reed switch that has been activated is associated.

Each bus relay coil 46 also operates a normally open latch contact 52 in a bus relay latch circuit 54. The latch contact 52 is in an electrical circuit running from the positive side of each bus relay coil 46 through the latch contact 52 to the positive side of the power source through a normally closed push switch 56.

The reed switches 24 of each cell are all connected to the same cell indicating circuit 42, with a cell indicating circuit 42 provided for each cell. Each cell indicating circuit 42 includes a cell relay coil 58 which has one pole connected to all of the reed switches 24 of a given cell through the diode 38 and its other pole connected to the negative side of the power supply. Each cell relay coil 58 operates a normally open cell relay contact 60 which is interposed in an electrical connection between the positive side of the power source and an indicating lamp 62 of any appropriate type which is in turn connected to the negative side of the power source. As in the case of lamps 50, lamps 62 may be mounted in a panel. The panel or the lamps themselves may be provided with a legend to provide an operator with the assigned number of the cells with which the reed switch 24 that has been activated is associated.

Each cell relay coil 58 also operates a normally open latch contact 64 in cell relay latch circuit 66. The latch circuit 66 runs from the positive side of the cell relay coil 58 through the latch relay contact 64 to the positive side of the power supply. All of the cell latch relay contacts 64 are electrically connected to the positive side of the power source through a normally closed push switch member 68. The switch member 68 may be mechanically connected to switch 56, to form a "gang" switch such that the pressing of a single member will open both switches.

A lamp test relay circuit 70 is provided to provide means for ascertaining if all of the lamps 50 and 62 of both the bus indicating circuits 40 and cell indicating circuits 42 are in working order. The lamp test relay circuit 70 includes a lamp test relay coil 72 having one pole attached to the negative side of the power supply and its other pole attached through a normally open push switch 74 to the positive side of the power supply. The lamp test relay coil 72 operates a normally open lamp test relay contact 76 associated with each one of the indicating lamps 50 and 62. Each contact 76 is in an electrical circuit extending from the positive side of each of the lamps 50 or 62 to the positive side of the power supply. Thus, when the switch 72 is depressed to close the lamp test relay circuit, the current will energize the lamp test relay coil 72 which in turn will close the lamp test relay contacts 76, thereby providing an electrical circuit through each one of the lamps. With the switch depressed, an operator may quickly scan all of the indicating lamps to see whether or not they are all in working order.

The reed switches 24 of each cell are all connected to the same anode raise circuit 44, with an anode raise circuit 44 being provided for each cell. Each anode raise circuit 44 includes an anode raiser relay coil 78 having one pole connected to each of the reed switches 24 of a given cell through the diode 36 and its other pole connected to the negative side of the power supply. Each anode raise relay coil 78 operates normally open anode raise contact 80 which is in an electrical circuit 82 connected to the motor actuation circuit 84 for each motor 22 associated with a given cell. A normally closed meter relay contact 86 may be provided in the electrical circuit 82 which is actuated by a meter relay coil 88 attached to suitable circuitry 90 to monitor the voltage of a given cell and open the electrical circuit 82 to stop the motor and the raising of the anodes when the voltage indicates the anodes have been raised a sufficient distance and if the reed switches 24 have not opened.

In operation, if a short circuit develops in one of the cells, the appropriate reed switch 24 will be actuated due to the increase in current. Upon closing of the reed switch, current flows through its associated bus relay coil 46, cell relay coil 58, and the anode raise relay coil 78. The bus relay coil 46, when energized due to the flow of current, will close the bus relay contact 48. Closure of the bus relay contact 48 causes current to flow through the indicating lamp 50 for that particular bus, lighting the lamp, and providing a visual indication of the bus on which the reed switch that has been activated is mounted. Similarly, the cell relay coil 58, when actuated by current flow, will close the cell relay contact 60, permitting current to flow through the indicating lamp, lighting the lamp, and providing a visual indication of the particular cell with which the reed switch that has been actuated is associated.

The anode raise relay coil 78, when energized, will cause the normally open anode raise relay contact 80 to close the circuit 74 which will in turn start the operation of the motor causing the cell cover 6 and the anodes 8 of the cell experiencing the short circuit to raise. The motor will continue to run until the activated reed switch 24 senses a specific decrease in current and opens, thereby de-energizing the anode raise relay coil 78 which, when de-energized, will permit the anode raise relay contact 80 to return to its normal open position.

Each bus relay coil 46, when energized, will close the bus latch relay contact 52 to permit current to flow in the bus relay latch circuit 54 through the switch 56. As mentioned, when the anodes have been raised relative to the cathode to overcome the short circuit, the reed switches 24 will open. However, due to the latch circuit 54, an electrical circuit separate from the reed switch 24 is provided through the relay coil 46 such that the relay contact 48 will remain closed and the indicating lamp 50 will continue to remain in the lighted condition until the reset switch 56 is depressed to open the circuit.

Each cell relay coil 58, when energized, will close the cell latch relay contact 64 to permit current to flow in the cell relay latch circuit 66 through the switch 68. After the reed switch has opened, the cell relay latch circuit 66 provides a closed circuit separate from the reed switch 24, through the cell relay coil 58 to keep it energized and keep the indicating lamp 62 in its lighted condition.

Although the present invention has been described in connection with a cell in which all of the anodes of the cell are simultaneously raised, and each one of the anode buses is provided with a sensing switch, the present invention is adaptable to other cell arrangements. For example, the cell might have its anodes divided into a plurality of groups, each group of which is capable of being raised independently of the others. In such a case, there would have to be a separate anode raise circuit for each cell group rather than just for the cell itself. It is also contemplated that in some instances it may be satisfactory if not all of the buses are provided with a sensing switch. For example, it may be sufficient in some cases to only provide one of the anode buses serving a given anode with a sensing switch.

By virtue of the above-described arrangement, a visual indication is given as to which cell and which particular bus bar on that cell is associated with the activated reed switch. Thus, an operator will be provided with a visual indication of the exact location of the reed switch which caused the anode raise motor to be actuated. This is particularly useful in the event that a reed switch has malfunctioned, since it can be located promptly and repaired or replaced.

What is claimed is:

1. An improvement for use in conjunction with the preventing of short circuits in one of a plurality of horizontal mercury cells for the production of chlorine electrically connected in series, each cell having means for raising a plurality of anodes relative to the flowing mercury cathode, and a plurality of anode buses associated with each plurality of anodes, said improvement comprising:

a. switch means associated with at least two of each plurality of anode buses of each plurality of anodes for closing an electrical circuit upon sensing a short circuit condition;

b. means responsive to the closing of the electrical circuit for indicating which ones of the plurality of anode buses the switch means that have closed are associated with;

c. means responsive to the closing of the electrical circuit for indicating which ones of the plurality of cells the switch means that have closed are associated with; and d. means responsive to the closing of the electrical circuit for causing the raising of the plurality of anodes with which the switch means that have closed are associated.

2. The improvement of claim 1 wherein each of said switch means is responsive to the change in flux of the magnetic field generated by electrical flow in the associated anode bus.

3. The improvement of claim 1 wherein said means for indicating include lamps.

4. The improvement of claim 3 further including a plurality of first relays, one of said first relays being electrically connected to each of all corresponding switch means of the different plurality of anode buses, a lamp associated with each first relay for activation upon energization of a corresponding first relay, a plurality of second relays, one of said second relays being electrically connected to each of all switch means associated with a given cell, a lamp associated with each second relay for activation upon energization of a corresponding second relay.

5. The improvement of claim 4 further including a plurality of third relays, one of said third relays being electrically connected to each of all switch means associated with a given plurality of anodes, and motor means associated with each plurality of anodes for raising the anodes upon energization of a corresponding third relay.

6. The improvement of claim 3 further including means for maintaining the lamps in a lit condition after the corresponding switch means has opened, and manual switch means for turning off the lamps.

7. The improvement of claim 3 further including electric circuit means for lighting all of said lamps independently of said switch means.

8. A method for use in conjunction with the preventing of short circuits in one of a plurality of horizontal mercury cells for the production of chlorine electrically connected in series, each cell having means for raising a plurality of anodes relative to the flowing mercury cathode, and a plurality of anode buses associated with each plurality of anodes, said method comprising:

a. providing switch means associated with at least two of the plurality of anode buses of each plurality of anodes for closing an electrical circuit upon the sensing of a short circuit condition;

b. visually indicating in response to the closing of the electrical circuit which one of the plurality of anode buses the switch means that have closed are associated with;

c. visually indicating in response to the closing of the electrical circuit which ones of the plurality of cells the switch means that have closed are associated with; and d. causing in response to the closing of the electrical circuit the raising of the plurality of anodes with which the switch means that have closed are mounted.

9. The method of claim 8 wherein said switch means senses the change in flux of the magnetic field generated by the electrical flow in the bus associated with the switch means.

10. The method of claim 8 wherein the visual indication is by lamps, each of said lamps being maintained in a lit condition upon opening of said switch means until turned off by a reset switch.

* * * * *